US008826986B2

(12) United States Patent
Wolf

(10) Patent No.: US 8,826,986 B2
(45) Date of Patent: Sep. 9, 2014

(54) DOWNHOLE SCRAPER

(75) Inventor: John C. Wolf, Houston, TX (US)

(73) Assignee: M-I L.L.C., Houston, TX (US)

( * ) Notice: Subject to any disclaimer, the term of this patent is extended or adjusted under 35 U.S.C. 154(b) by 441 days.

(21) Appl. No.: 12/681,010

(22) PCT Filed: Oct. 1, 2008

(86) PCT No.: PCT/US2008/078409

§ 371 (c)(1),
(2), (4) Date: Jun. 25, 2010

(87) PCT Pub. No.: WO2009/046077

PCT Pub. Date: Apr. 9, 2009

(65) Prior Publication Data

US 2010/0258318 A1 Oct. 14, 2010

Related U.S. Application Data

(60) Provisional application No. 60/977,232, filed on Oct. 3, 2007.

(51) Int. Cl.
*E21B 37/02* (2006.01)

(52) U.S. Cl.
CPC ..... *E21B 37/02* (2013.01)
USPC ..... 166/311; 166/173

(58) Field of Classification Search
USPC ..... 166/170, 173, 175, 176, 241.6, 311; 175/323; 15/104.05, 104.09, 104.095, 15/104.096, 104.16, 104.2, 114, 117, 118, 15/121, 245, 250.48
See application file for complete search history.

(56) References Cited

U.S. PATENT DOCUMENTS

| | | | | | |
|---|---|---|---|---|---|
| 1,084,871 | A | * | 1/1914 | Tuck | 299/87.1 |
| 1,897,507 | A | * | 2/1933 | Morgan | 166/175 |
| 2,166,937 | A | * | 7/1939 | Bettis | 175/325.5 |
| 2,214,982 | A | * | 9/1940 | Wylie | 15/104.061 |
| 2,220,237 | A | * | 11/1940 | Hall | 166/172 |

(Continued)

FOREIGN PATENT DOCUMENTS

| | | | |
|---|---|---|---|
| GB | 2327963 | A | 2/1999 |
| GB | 2403743 | A | 1/2005 |
| WO | 0198621 | A2 | 12/2001 |

OTHER PUBLICATIONS

Dictionary definitions of "abrade" "abrasive" "apply" "coating" "deflect" "helix" "layer" and "scrape", accessed Mar. 11, 2013 via thefreedictionary.com.*

(Continued)

*Primary Examiner* — Kenneth L Thompson
*Assistant Examiner* — Blake Michener
(74) *Attorney, Agent, or Firm* — Osha Liang LLP

(57) ABSTRACT

A downhole tool including a resilient body configured to be disposed on a drill string, the resilient body comprising a plurality of radial blades having an abrasive coating, wherein the radial blades are configured to deflect when inserted into downhole tubing, and wherein the resilient body is configured to allow rotation relative to the drill string. Additionally, a method for cleaning downhole tubing, the method including inserting a resilient scraper disposed on a drill string into the downhole tubing, the resilient scraper including a plurality of radial blades having an abrasive coating. The method further including rotating the drill string, and contacting the resilient scraper to an internal wall of the downhole tubing.

16 Claims, 6 Drawing Sheets

(56) References Cited

U.S. PATENT DOCUMENTS

| | | | | | |
|---|---|---|---|---|---|
| 2,275,939 | A | | 3/1942 | Baker | |
| 2,321,275 | A | * | 6/1943 | Blackburn | 166/176 |
| 2,334,788 | A | * | 11/1943 | O'Leary | 175/267 |
| 2,402,223 | A | * | 6/1946 | Wright | 166/173 |
| 2,679,383 | A | * | 5/1954 | Garrison | 175/269 |
| 2,695,673 | A | * | 11/1954 | Coyle | 166/170 |
| 2,781,100 | A | | 2/1957 | Pyle et al. | |
| 2,870,845 | A | * | 1/1959 | Tripplehorn | 166/176 |
| 3,083,773 | A | * | 4/1963 | Nagel et al. | 166/176 |
| 3,116,576 | A | * | 1/1964 | Block | 451/469 |
| 3,251,919 | A | * | 5/1966 | Ell | 264/251 |
| 3,351,136 | A | * | 11/1967 | Nelson | 166/173 |
| 3,410,349 | A | * | 11/1968 | Troutman | 166/176 |
| 4,050,514 | A | | 9/1977 | Prenn | |
| 4,796,670 | A | | 1/1989 | Russell et al. | |
| 4,798,246 | A | | 1/1989 | Best | |
| 4,809,779 | A | | 3/1989 | Ledyashov et al. | |
| 5,040,620 | A | * | 8/1991 | Nunley | 175/61 |
| 5,042,600 | A | * | 8/1991 | Finnegan et al. | 175/323 |
| 5,127,125 | A | * | 7/1992 | Skibowski | 15/104.061 |
| 5,419,397 | A | | 5/1995 | Reynolds et al. | |
| 5,570,742 | A | * | 11/1996 | Reynolds et al. | 166/173 |
| 5,819,353 | A | | 10/1998 | Armell et al. | |
| 5,915,436 | A | * | 6/1999 | Johnson et al. | 15/187 |
| 5,937,957 | A | | 8/1999 | Swietlik | |
| 6,152,220 | A | * | 11/2000 | Carmichael et al. | 166/173 |
| 6,223,840 | B1 | | 5/2001 | Swietlik | |
| 6,347,667 | B1 | | 2/2002 | Howlett et al. | |
| 6,484,802 | B1 | | 11/2002 | McGarian et al. | |
| 6,575,239 | B2 | * | 6/2003 | Allen | 166/170 |
| 7,143,829 | B2 | | 12/2006 | Booth | |
| 7,404,436 | B2 | * | 7/2008 | Booth | 166/173 |
| 2001/0040035 | A1 | * | 11/2001 | Appleton et al. | 166/387 |
| 2001/0042623 | A1 | * | 11/2001 | Reynolds | 166/312 |
| 2003/0010540 | A1 | * | 1/2003 | Kirk et al. | 175/325.5 |
| 2005/0167159 | A1 | * | 8/2005 | Bailey et al. | 175/72 |
| 2006/0081375 | A1 | * | 4/2006 | Ruttley | 166/311 |
| 2008/0086826 | A1 | * | 4/2008 | Hardy et al. | 15/104.14 |
| 2009/0088055 | A1 | * | 4/2009 | Silva et al. | 451/541 |

OTHER PUBLICATIONS

Dictionary definitions of "apply", "coating", "deflect", "helix", "layer" and "scrape", accessed May 28, 2013 via thefreedictionary.com.*

Canadian Search Report for Canadian Application 2,701,560 Dated Oct. 24, 2011 (3 pages).

International Search Report issued in PCT/US2008/078409, mailed on Apr. 13, 2009, 3 pages.

Written Opinion issued in PCT/US2008/078409, mailed on Apr. 13, 2009, 4 pages.

Examiner's Search Report Issued in Canadian Application No. 2,701,560, Dated Sep. 5, 2012 (3 pages).

Examiner's Report issued in corresponding Canadian Application No. 2,701,560; Dated Apr. 30, 2014 (2 pages).

* cited by examiner

DOWNHOLE SCRAPER

BACKGROUND

1. Field of the Disclosure

Embodiments disclosed herein generally relate to apparatuses and methods for cleaning tubing used in downhole environments. More specifically, apparatuses and methods disclosed herein may be used in cleaning casing used in connection with oil and gas wells.

2. Background Art

Hydrocarbons (e.g., oil, natural gas, etc.) are obtained from a subterranean geologic formation (i.e., a "reservoir") by drilling a wellbore that penetrates the hydrocarbon-bearing formation. In order for the hydrocarbons to be produced, that is, travel from the formation to the wellbore, and ultimately to the surface, at rates of flow sufficient to justify their recovery, a sufficiently unimpeded flowpath from the subterranean formation to the wellbore, and then to the surface, must exist or be provided.

Subterranean oil recovery operations may involve the injection of an aqueous solution into the oil formation to help move the oil through the formation and to maintain the pressure in the reservoir as fluids are being removed. The injected aqueous solution, usually surface water (lake or river) or seawater (for operations offshore), generally contains soluble salts such as sulfates and carbonates. These salts may be incompatible with the ions already contained in the oil-containing reservoir. The reservoir fluids may contain high concentrations of certain ions that are encountered at much lower levels in normal surface water, such as strontium, barium, zinc and calcium. Partially soluble inorganic salts, such as barium sulfate (or barite) and calcium carbonate, often precipitate from the production water as conditions affecting solubility, such as temperature and pressure, change within the producing wellbores and topsides. This is especially prevalent when incompatible waters, such as formation water, seawater, or produced water, encounter soluble inorganic salts.

A common reason for a decline in hydrocarbon production is the formation of scale in or on the wellbore, in the near-wellbore area or region of the hydrocarbon-bearing formation matrix, and in other pipes or tubing. Oilfield operations often result in the production of fluid containing saline-waters as well as hydrocarbons. The fluid is transported from the reservoir via pipes and tubing to a separation facility, where the saline-waters are separated from the valuable hydrocarbon liquids and gasses. The saline-waters are then processed and discharged as waste water or re-injected into the reservoir to help maintain reservoir pressure. The saline-waters are often rich in mineral ions such as calcium, barium, strontium and iron anions and bicarbonate, carbonate and sulphate cations.

Generally, scale formation occurs from the precipitation of minerals, such as barium sulfate, calcium sulfate, and calcium carbonate, which become affixed to or lodged in the pipe or tubing. When the water (and hence the dissolved minerals) contacts the pipe or tubing wall, the dissolved minerals may begin to precipitate, forming scale. These mineral scales may adhere to pipe walls as layers that reduce the inner bore of the pipe, thereby causing flow restrictions. Not uncommonly, scale may form to such an extent that it may completely choke off a pipe. Oilfield production operations may be compromised by such mineral scale. Therefore, pipes and tubing may be cleaned or replaced to restore production efficiency.

Generally, operations to clean downhole tubing include the use of scrapers to remove debris from the inside surface of the tubes. Debris, in addition to scale deposits as discussed above, may include metal or oxidation particles, burrs, cement, and shavings. In other cleaning operations, downhole tubing is cleaned during the displacement from drilling fluids to completion fluids. Common operations used for clean-up operations are slow and inefficient. Specifically, operations used to clean downhole tubing often result in broken scrapers, production downtime, and inefficient cleaning operations.

Accordingly, there exists a need for more efficient debris removal tools for use in downhole cleaning operations.

SUMMARY OF THE DISCLOSURE

In one aspect, embodiments disclosed herein relate to a downhole tool including a resilient body configured to be disposed on a drill string, the resilient body having a plurality of radial blades having an abrasive coating, wherein the radial blades are configured to deflect when inserted into downhole tubing. Additionally, wherein the resilient body is configured to allow rotation relative to the drill string.

In another aspect, embodiments disclosed herein relate to a downhole tool including a drill string and a resilient scraper disposed on a portion of the drill string, the scraping including a plurality of radial blades having an abrasive coating.

In another aspect, embodiments disclosed herein relate to a method for cleaning downhole tubing, the method including inserting a resilient scraper disposed on a drill string into the downhole tubing, the resilient scraper including a plurality of radial blades having an abrasive coating. Additionally, the method including rotating the drill string and contacting the resilient scraper to an internal wall of the downhole tubing.

In another aspect, embodiments disclosed herein relate to a method of manufacturing a downhole tool, the method including encasing a mandrel with a base material and applying a binder to the base material to form a core. Additionally, the method including forming a plurality of radial blades from the core, at least one of the radial blades having a blade angle between 20° to 60°, and applying an abrasive to the radial blades.

Other aspects and advantages of the invention will be apparent from the following description and the appended claims.

DETAILED DESCRIPTION

In one aspect, embodiments disclosed herein relate to apparatuses and methods for cleaning tubing used in downhole environments. More specifically, apparatuses and methods disclosed herein may be used in cleaning casing used in connection with oil and gas wells.

Figure 1:
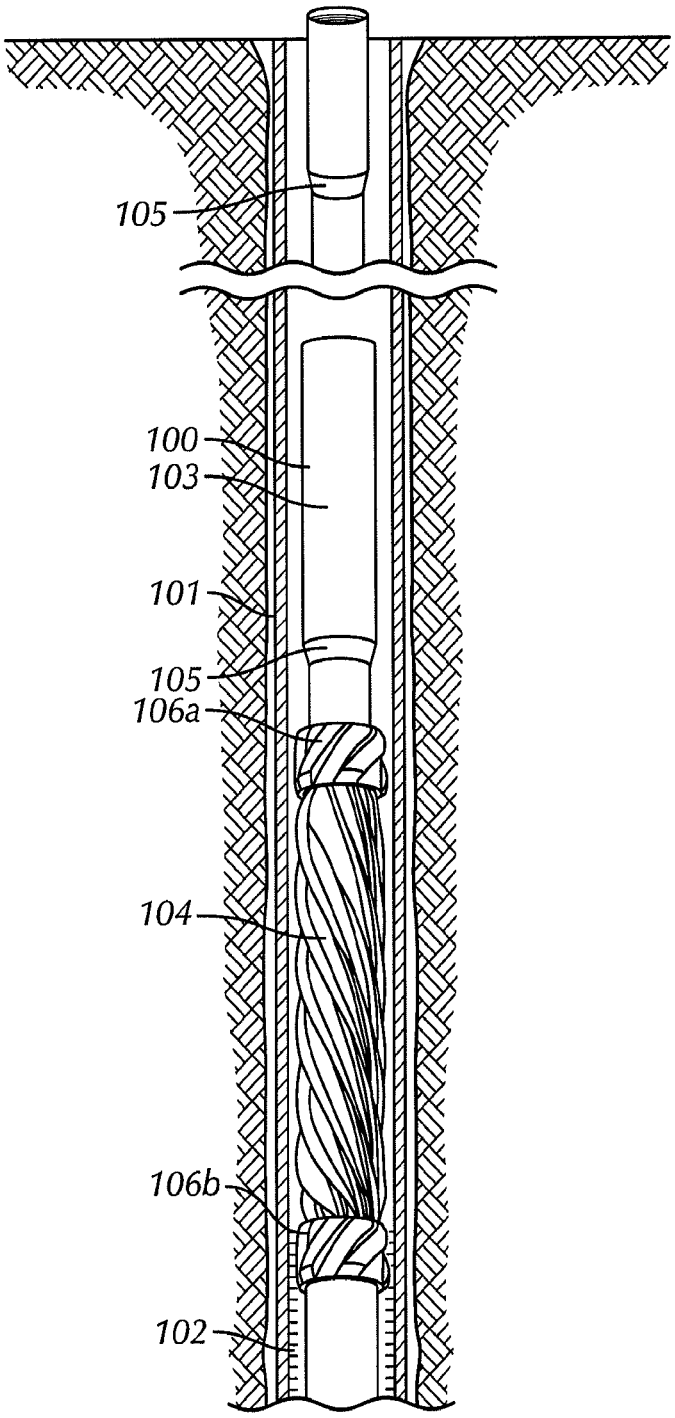
FIG. 1 is a vertical schematic view of a well during cleaning with a downhole tool in accordance with an embodiment of the present disclosure.

Referring to FIG. 1, a vertical schematic of a well during cleaning with a downhole tool in accordance with an embodiment of the present disclosure is shown. As illustrated, a wellbore 100 is lined with downhole tubing 101 (e.g., casing). Along the inner diameter of downhole tubing 101, debris 102, such as scale deposits, metal or oxidation particles, burrs, cement, and shavings, have collected. In this embodiment, a downhole tool 103 including a resilient scraper 104 is illustrated disposed on a drill string 105. Downhole tool 103 also includes two centralizers 106. A first centralizer 106*a* is disposed on downhole tool 103 in a distal position (i.e., lower on the drill string), while a second centralizer 106*b* is disposed on downhole tool 103 in a proximal position (i.e., closer to the surface of the wellbore). Thus, resilient scraper 104 may move longitudinally within the area defined by first and second centralizers 106*a* and 106*b*.

While only a single resilient scraper 104 is illustrated, those of ordinary skill in the art will appreciate that a plurality of resilient scrapers 104 may be disposed along portions of the drill string 105. By increasing the number of resilient scrapers 104, more efficient removal of debris from tubing may be achieved.

Figure 2:
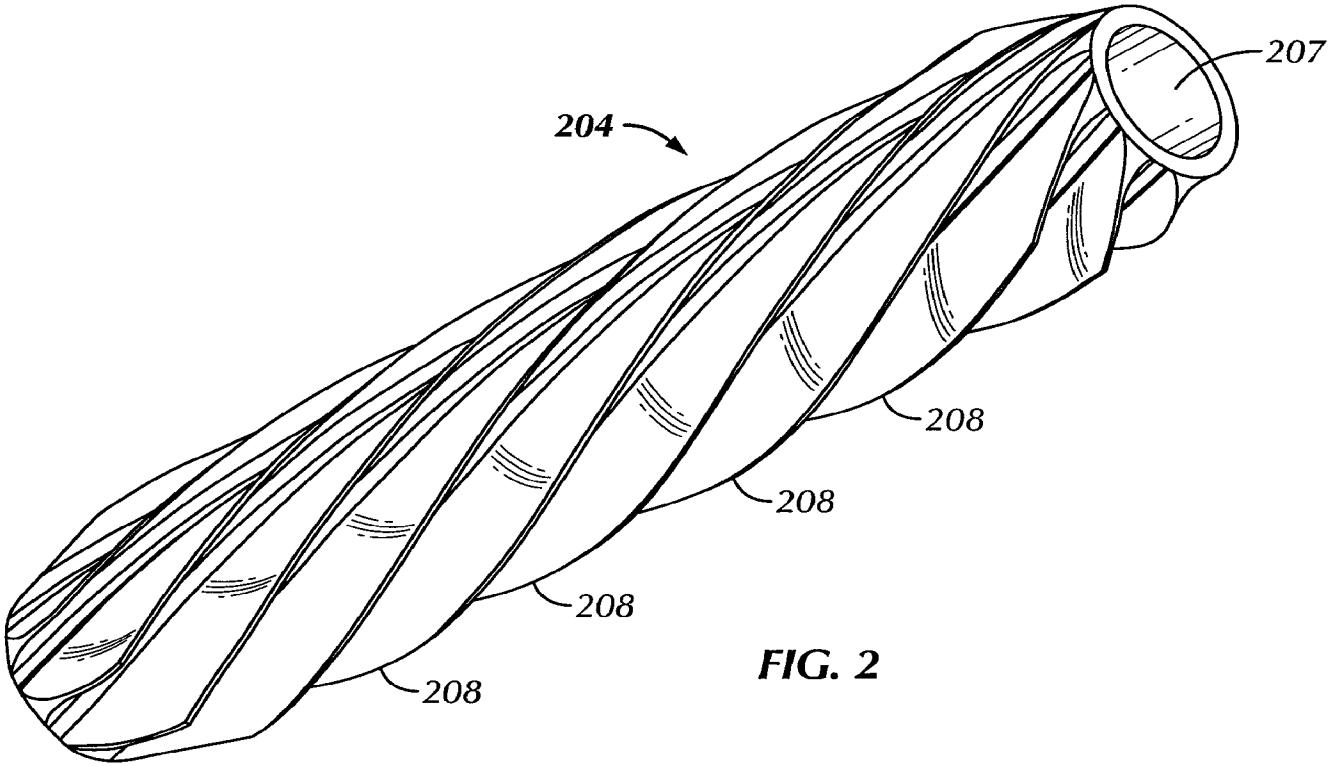
FIG. 2 is a perspective view of a resilient scraper according to one embodiment of the present disclosure.

Referring to FIG. 2, a perspective of a resilient scraper 204 according to one embodiment of the present disclosure is shown. Resilient scraper 204 includes a substantially hollow core section 207. Core section 207 has an internal diameter that allows resilient scraper 204 to fit over a portion of a drill string, as shown in FIG. 1. Additionally, in this embodiment, resilient scraper 204 is illustrated including a plurality of radially extending blades 208. Blades 208 extend from core 207 biased at a predetermined blade angle, which will be discussed in detail below. Because blades 208 are biased in a specified orientation, and because blades 208 are deflectable, blades 208 may bend in a generally inward direction (i.e., counterclockwise with respect to FIG. 2) during use. As such, if a drill string (not shown) has resilient scraper 204 disposed thereon, and is rotated in a clockwise direction within downhole tubing (not shown), blades 208 may flex inwardly, as described above. Thus, should resilient scraper 204 become stuck during use (e.g., caused to rotate with the drill string), damage to blades 208 may be avoided.

Figure 3:
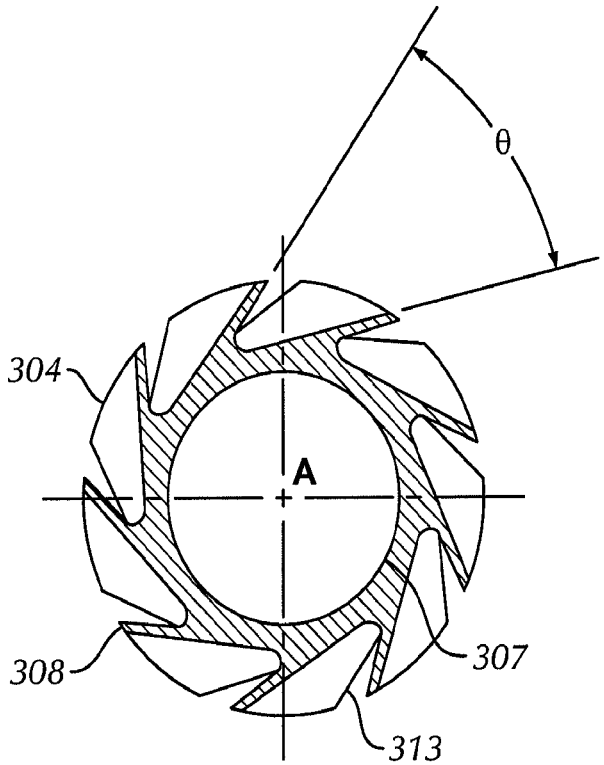
FIG. 3 is a cross-sectional view of a resilient scraper according to one embodiment of the present disclosure.

Referring to FIG. 3, a cross-sectional view of a resilient scraper 304 according to one embodiment of the present disclosure is shown. As illustrated, resilient scraper 304 includes a plurality of blades 308 extending radially from a core 307. A plurality of blades 308 are disposed around core 307 according to a blade angle Θ, which defines the angle between adjacent blades. Those of ordinary skill in the art will appreciate that depending on constraints of the specific cleaning operation, blade angle Θ may vary within a range of 0° and 90°. Those of ordinary skill in the art will further appreciate that a range of between 20° and 60° may be preferable for most cleaning operations.

As illustrated, resilient scraper 304 has nine blades 308. However, in other embodiments, the number of blades 308 may include more or less than nine blades 308. For example, in certain embodiments it may be preferable to include six blades all having substantially equivalent blade angles Θ. In other embodiments, resilient scraper 304 may include, for example, ten blades 308, wherein certain blades 308 have a blade angle of 20° while other blades have a blade angle of 60°. Those of ordinary skill in the art will appreciate that any combination of blade number and blade angle may be combined to produce an optimized resilient scraper 304 for a certain cleaning operation.

Still referring to FIG. 3, resilient scraper 304 also includes a scraper axis A. Scraper axis A is the geometric center of resilient scraper 304, and the general point about which resilient scraper 304 passively rotates during use. In operation, resilient scraper 304 may be disposed on a drill string (see FIG. 1). In such an embodiment, as the drill string is rotated and/or inserted into a wellbore, resilient scraper 304 may generally rotate around scraper axis A, in accordance with the movement of the drill string. However, those of ordinary skill in the art will appreciate that, because resilient scraper 304 is not fixed into place on the drill string, resilient scraper 304 may passively rotate around the drill string addition. Thus, in certain applications, resilient scraper 304 may rotate around the drill string during use, while in other applications, contact between the downhole tubing and blades 308 may not be sufficient to cause resilient scraper 304 to rotate.

Additionally, as resilient scraper 304 moves within the wellbore, blades 308 may be deformed against the inner diameter of the wellbore. As such, during use, blades 308 may bend inwardly. Thus, blade angle Θ may further define a bias point to which blades 308 return when resilient scraper 304 is either not in use or when blades 308 are not deformed.

The curvature of blades 308 result in a plurality of helical channels 313 being formed along resilient scraper 304. Helical channels 313 allow drilling fluids to flow between the internal diameter of the tubing and blades 308 of resilient scraper 304. Thus, as resilient scraper 304 is moved inside the downhole tubing, drilling fluid may flow through helical channels 313 to clean out debris as it is removed from the tubing.

Figure 4:
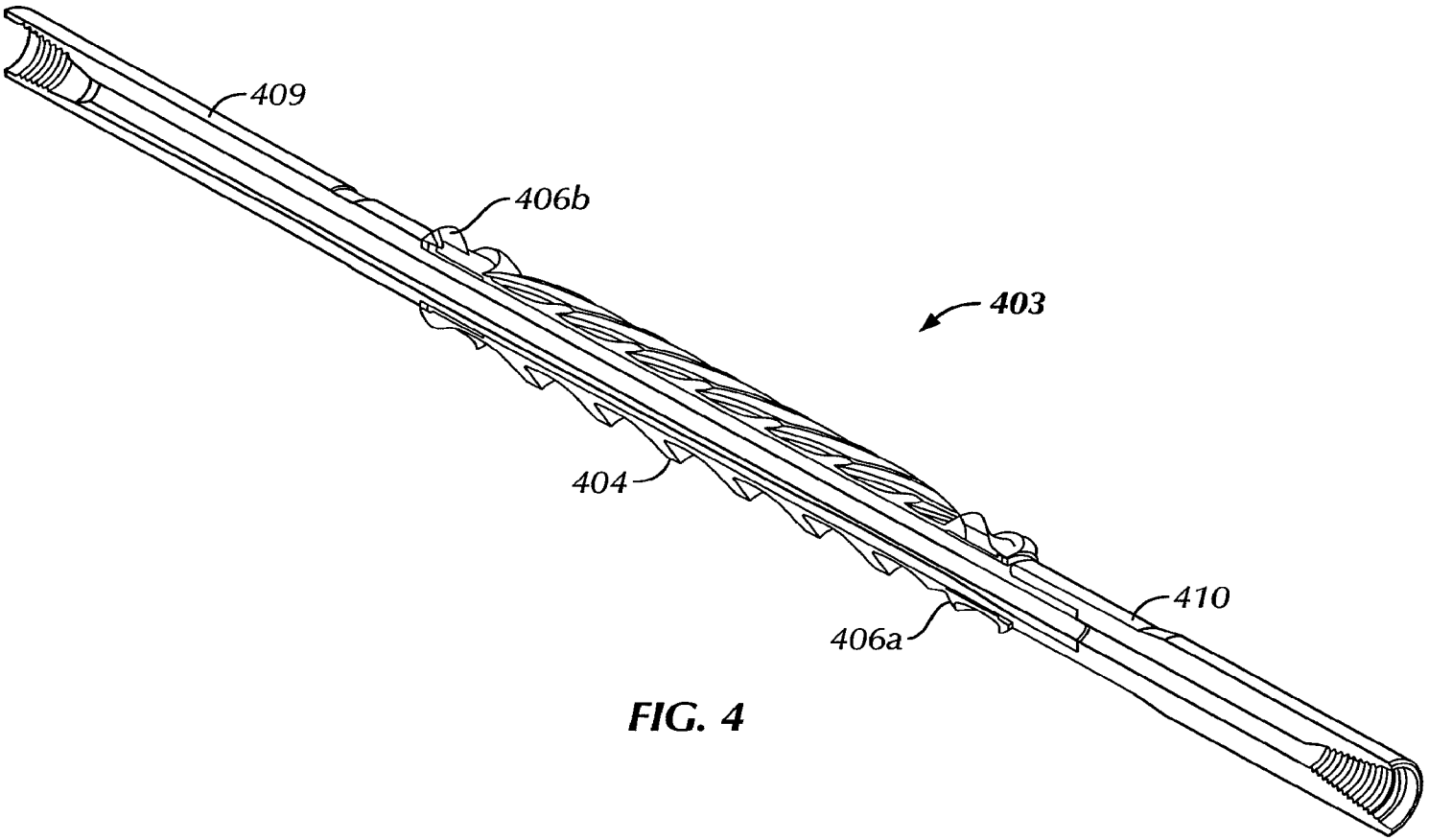
FIG. 4 is a cross-sectional view of a drilling tool having a resilient scraper according to one embodiment of the present disclosure.

Referring to FIG. 4, a cross-sectional view of a drilling tool 403 having a resilient scraper 404 is shown. In this embodiment, drilling tool 403 in addition to resilient scraper 404, includes a first and second centralizer 406*a* and 406*b*. Drilling tool 403 also includes a mandrel 409 onto which second centralizer 406*b* and resilient scraper 404 are disposed. In this embodiment, resilient scraper 404 is disposed on mandrel 409 between second centralizer 406*b* and first centralizer 406*a*. A bottom sub 410 is coupled to mandrel 409, such that first centralizer 406*a*, resilient scraper 404, and second centralizer 406*b* are held in place.

In this embodiment, first and second centralizers 406*a* and 406*b* are allowed to rotate freely around mandrel 409. However, those of ordinary skill in the art will appreciate that in other embodiments, centralizers 406*a* and/or 406*b* may be locked into place, so as to not be rotable relative to mandrel 409. Additionally, in other embodiments, drilling tool 403 may only have one centralizer 406, more than two centralizers 406, or no centralizers.

Generally, centralizers 406 are disposed on drilling tool 403 to constrain the longitudinal movement of resilient scraper 404 along mandrel 409. Centralizers 406 may also facilitate consistent contact between the blades and the inner diameter of the wellbore tubing, and help control wear of the blades due to the contact. Those of ordinary skill in the art will appreciate that by varying the number and placement of centralizers 406, contact between resilient scraper 404 and the inner diameter of the wellbore tubing may be modified.

Figure 5A:
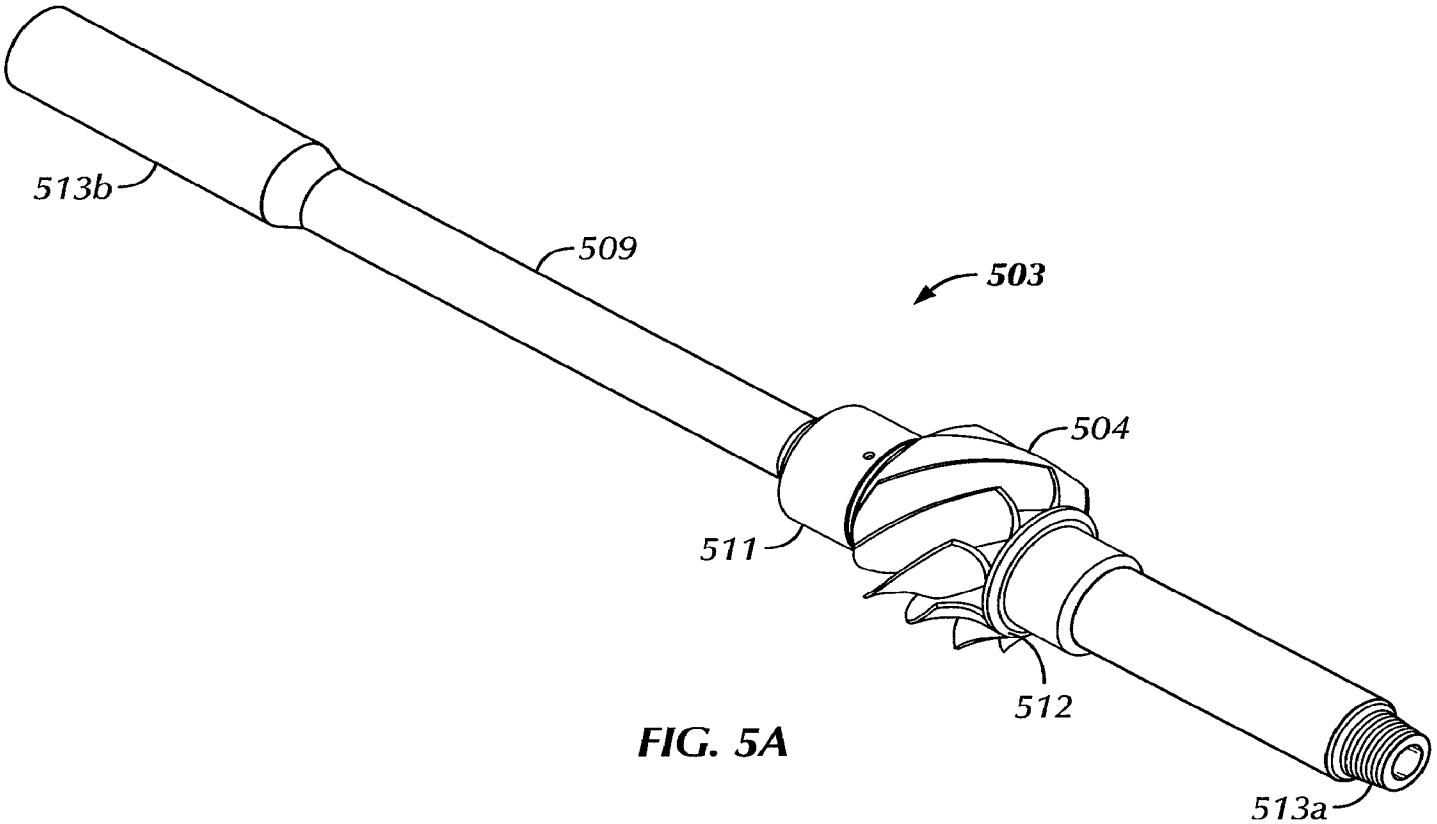
FIG. 5*a* is a perspective view of a drilling tool having a resilient scraper according to one embodiment of the present disclosure.

Referring briefly to FIG. 5*a*, a drilling tool 503 having a resilient scraper 504 according to one embodiment of the present disclosure is shown. In this embodiment drilling tool 503 includes a mandrel 509 and a resilient scraper 504 held in place with a retaining device 511. In such an embodiment, a drilling operator may slide resilient scraper 504 onto mandrel 509 until resilient scraper 504 contacts an end plate 512. Endplate 512 provides a stop, such that resilient scraper is held in place longitudinally along the drill string during use.

In this embodiment, drilling tool 503 is attached to a drill string (not shown) via connectors 513. As illustrated, drilling tool 503 has connectors 513 at both ends of the tool, wherein one end is a pin connection 513*a* and the other end is a box connection 513*b*. Those of ordinary skill in the art will appreciate that pin and box connectors are well known in the art as methods of coupling drilling tools to drill strings.

Figure 5B:
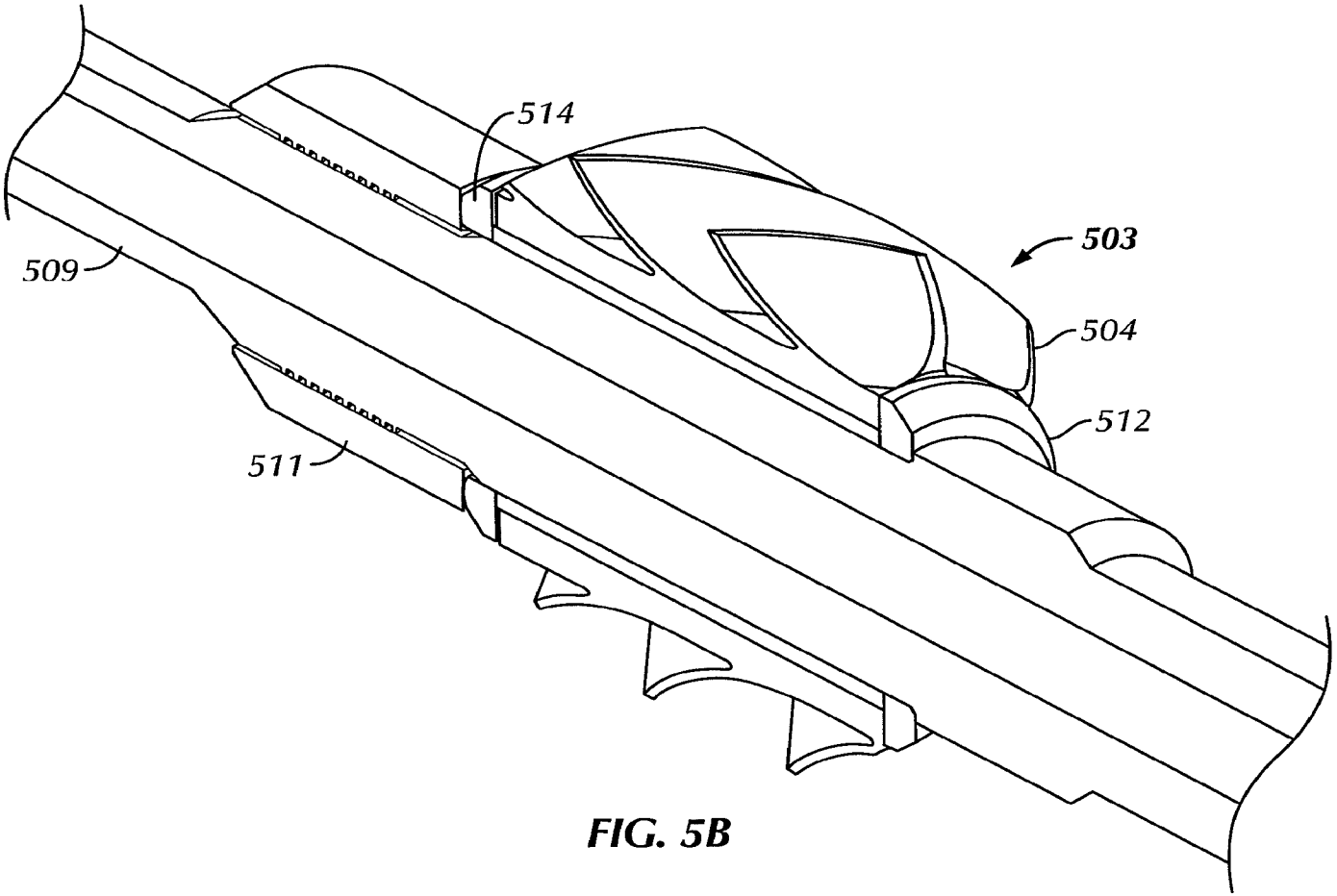
FIG. 5*b* is a cross-sectional view of a drilling tool having a resilient scraper according to one embodiment of the present disclosure.

Referring to FIG. 5*b*, a cross-sectional view of the drilling tool of FIG. 5*a*, according to one embodiment of the present disclosure, is shown. As indicated above, drilling tool 503 includes mandrel 509 and resilient scraper 504, held in place between end plate 512 and retaining device 511. As illustrated, retaining device 511 prevents resilient scraper 504 from moving longitudinally during use. In this embodiment, retaining device 511 couples to mandrel 509 by screwing into place. However, those of skill in the art will appreciate that other methods of coupling retaining device 511 to mandrel 509 are possible, and as such, within the scope of the present disclosure.

To further enhance the coupling of retaining device 511 to mandrel 509, additional components such as set screw 514, washers and/or other sealing elements (not shown), or centralizers (not shown) may be used. Such additional components may secure resilient scraper 504 to mandrel 509 and/or retaining device 511, or otherwise enhance the cleaning effectiveness of resilient scraper 504.

Without specific reference to the above described Figures, during operation a downhole tool having a resilient scraper is inserted into downhole tubing, such as a casing sleeve. Before insertion, the blades may radially extend further than the internal diameter of the downhole tubing. Thus, during insertion, the blades may radially compress to conform to the internal diameter of the tubing. After insertion, the drill string may be moved inside the downhole tubing such that the blades of the resilient scraper contact at least a portion of the internal diameter of the tubing. The movement may include rotating the drill string, so that the blades are rotated, or may include longitudinal movement not imparting rotation to either the drill string, downhole tool, or the resilient scraper independently. The contact between the blades and the internal diameter of the tubing may thus facilitate the removal of debris from the tubing.

Additionally, because the radial blades form a helical channel between the internal diameter of the tubing and the downhole tool, drilling fluid is allowed to circulate therethrough. Because drilling fluid may freely flow over the inner diameter of the tubing, debris may be carried away from the tubing and allowed to flow to the surface of the wellbore for processing. The free flow of fluid may also clean the radial blades, so as to both remove debris from the blades, as well as cool the blade to further decrease the wear potential on the blades.

Manufacturing a resilient scraper includes encasing a mandrel with a base material. In one embodiment, the base material may include, for example, wrapping the mandrel with carbon fiber sheets and then applying a polyaryletheretherketone binder over the carbon fiber. In other embodiments, a base material including carbon fiber particles may be applied with a polytetrafluoroethylene or other plastic binder to hold the carbon fiber in place. Those of ordinary skill in the art will appreciate that alternate combinations of polytetrafluoroethylene, polyaryletheretherketone, or other plastics may be combined as binders and applied to carbon fiber, polytetrafluoroethylene, and other base materials to form a core from which the resilient scraper may be formed.

In other embodiments, the resilient scraper may be formed by wrapping a steel mandrel with a carbon fiber filament while applying a binder to hold the carbon fiber filament in place. In still other embodiments, the resilient scraper may be formed by machining the resilient scraper blades from a solid piece of polytetrafluoroethylene tubing. Those of ordinary skill in the art will appreciate that alternate methods of forming resilient scraper may also exist, and as such, modifications to the above disclosed methods of forming the resilient scraper are within the scope of the present disclosure.

After the core is formed from base materials, binders, and other materials known to those of ordinary skill in the art, the design of the resilient scraper is formed. From the core, a plurality of radial blades are formed by, for example milling the core into a specified geometry. As described above, in one embodiment, the blades may be milled to include a blade angle of between 20° and 60°. Examples of forming the blades may include the manual forming of the blades, or automated forming of the blades on, for example, a lathe. In other embodiments, the blades may be formed by laser etching or other methods of forming such blades known to those of ordinary skill in the art.

After the blades are formed from the core, an abrasive is applied to the formed blades. In one embodiment, the abrasive may include aluminum oxide, silicon carbide, and/or other abrasives known to those of ordinary skill in the art. Additionally, combinations of abrasives may be applied to the blades in layers, or in combination, to optimize the wear dynamics of the blade. In addition to applying abrasive to the blades, abrasive may be applied to any exposed surface of the core that has not been formed into blades. In certain embodiments it may be beneficial to coat the internal diameter of the core with abrasives, however, generally, such application of abrasive is not necessary. Additionally in other embodiments, other materials may be applied to the internal diameter of the core to, for example, decrease friction between the mandrel and the resilient scraper.

The application of the abrasive may include dipping the core including the formed blades into an abrasive. In other embodiments, the abrasive may be applied with an epoxy such that proper bonding of the abrasive to the base material is achieved. Those of skill in the art will appreciate that the ratio of abrasive to epoxy may be varied to achieve different levels of coating ease and/effectiveness. Significantly, the application of the abrasive and epoxy must be consistent over the blade surface to achieve maximum benefit. During field testing, it has been determined that by varying the percent abrasive to the percent epoxy used in the application, the coating effectiveness was directly effected. In the tests, different concentrations of abrasive to epoxy were applied to a polytetrafluoroethylene surface. The surfaced polytetrafluoroethylene was then contacted against a corroded 4140 steel surface with approximately 20 pounds of contact force for 6-8 stokes. The results of the test are as follows:

TABLE 1

Abrasive Effectiveness on 4140 Tubing

| Sample Number | Abrasive Type | Abrasive Percent | Epoxy Percent | Coating Effectiveness |
|---|---|---|---|---|
| 1 | Aluminum Oxide #320 | 50% | 50% | GOOD |
| 2 | Silicon Carbide | 50% | 50% | MEDIUM |
| 3 | Aluminum Oxide #120 | 50% | 50% | POOR |
| 4 | Aluminum Oxide #60 | 66% | 33% | MEDIUM |
| 5 | Aluminum Oxide #320 | 66% | 33% | GOOD |
| 6 | Silicon Carbide | 66% | 33% | POOR |

TABLE 1-continued

| Abrasive Effectiveness on 4140 Tubing | | | | |
|---|---|---|---|---|
| Sample Number | Abrasive Type | Abrasive Percent | Epoxy Percent | Coating Effectiveness |
| 7 | Aluminum Oxide #120 | 66% | 33% | POOR |
| 8 | Aluminum Oxide #60 | 66% | 33% | GOOD |

The above results indicate that by varying combinations of abrasive and epoxy, variations of coating effectiveness may be achieved. During manufacturing of the resilient scrapers, or during resurfacing, as will be explained in detail below, the ratio of abrasive to epoxy may thus be varied. Furthermore, different combinations of abrasive to epoxy may also result in more or less difficulty in application. For example, in separate laboratory tests, it was observed that aluminum oxide mixed at 66% with a 33% epoxy resulted in the hardest combination to apply, while silicon carbide at 50% mixed with 50% epoxy was one of the easiest. Considerations such as ease of application may also be a factor when resurfacing of the resilient scraper is performed in the field.

Another consideration during abrasive and epoxy application is the impact resistance and bendability of the combination. During a lab test in which all of the above combinations were subjected to impact with a brass hammer, it was observed that none of the abrasive/epoxy bonds failed. However, extreme bending of certain combinations resulted in cracks indicative of cracks that may form during cleaning operations. Generally, by increasing the percentage of abrasive relative to epoxy, the stiffness of the material was increased. The results of the tests are as follows:

TABLE 2

| Results of Impact/Bend Test | | | | |
|---|---|---|---|---|
| Sample Number | Abrasive Type | Abrasive Percent | Epoxy Percent | Bond Quality |
| 1 | Aluminum Oxide #320 | 50% | 50% | Separated very slightly at bottom (epoxy not 100% cured) |
| 2 | Silicon Carbide | 50% | 50% | Cracked where PTFE cracked. Still fully bonded. (epoxy fully cured) |
| 3 | Aluminum Oxide #120 | 50% | 50% | No cracks or separations (epoxy not 100% cured) |
| 4 | Aluminum Oxide #60 | 66% | 33% | PTFE cracked but Epoxy bond held. (epoxy fully cured) |
| 5 | Aluminum Oxide #320 | 66% | 33% | PTFE fractured fully - Epoxy held. (epoxy fully cured) |
| 6 | Silicon Carbide | 66% | 33% | No cracks or separations (epoxy not 100% cured) |
| 7 | Aluminum Oxide #120 | 66% | 33% | No cracks or separations (epoxy not 100% cured) |
| 8 | Aluminum Oxide #60 | 66% | 33% | No cracks or separations (epoxy fully cured) |

The above lab test illustrates that by varying the abrasive to epoxy percentages, different levels of bendability and impact resistance may be achieved. As such, those of ordinary skill in the art will appreciate that by varying the abrasives, epoxies, and percentages of both relative to one another, different material properties may be achieved. Because certain cleaning operations may require greater flexibility of the resilient blades, such as cleaning operations involving relative small casing, a material with greater bendability may be desired. In other applications, a more impact resistance material may be desired if the tubing being cleaned has relatively harder debris disposed thereon.

Advantageously, embodiments of the present disclosure provide for downhole cleaning tools that may increase the effectiveness of debris removal from downhole tubing. In certain embodiments, the rate of cleaning may be increased due to an increased coverage area of the blades on the inner diameter of the downhole tubing during use. Because the blades cover substantially 360° of the downhole tool, as the tool is moved in the wellbore, substantially continuous contact between the blades and the inner diameter of the downhole tube may be achieved. Furthermore, because the blades are deformable, the blades may deflect to match the contours of the wellbore, thereby increasing the coverage as compared to conventional fixed scrapers.

Also advantageously, the specific gravity of the components of the blades is less than the specific gravity of drilling fluids typically used in cleaning operations. Thus, if a blade, or a portion of a blade breaks during drilling, the portion of the blade removed from the tool will return to the surface during the normal flow of drilling fluid through the tubing. As such, even if a tool breaks during use, the cleaning operation and/or subsequent well production may not be inhibited by the broken tool.

Those of ordinary skill in the art will appreciate that when a resilient scraper is used downhole, the abrasive, or even a portion of the core may be removed during normal use. Because an abrasive may be reapplied between uses, a drilling operator may reapply or reform the tool for use in subsequent cleaning operations. For example, if the abrasive of the resilient scraper is removed during use downhole, a drilling operator may remove the downhole tool, resurface the resilient with additional abrasive, and then reemploy the tool in subsequent cleaning operations. Such resurfacing applications may thereby allow a tool to be used in multiple drilling operations, while reusing existing equipment. Such benefits may reduce the cost of cleaning operations, thereby increasing the efficiency of the entire operation.

However, should a component of the resilient blades break downhole, and fail to be washed to the surface by the drilling fluid, the material the blades are formed from is easily drillable. Because broken blades or other portions of the drilling tool are easily drillable, even if a tool breaks, the broken tool may not interfere with subsequent drilling and/or production operations.

Also advantageously, because the base materials and abrasives are generally regarded as being chemically inert, drilling fluids and environmental conditions in downhole tubing will not degrade the components of the drilling tool. Furthermore, the chemical inert properties of the components will prevent leaching of potentially dangerous substances into the downhole tubing, which could otherwise interfere with environmental considerations or production operations.

Finally, embodiments of the present disclosure may prevent downtime on a rig due to encountering a casing restriction during a finishing operation. Conventional scrapers may become stuck in casing restrictions due to their non-resilient construction. As such, a large amount of force may be required to extract such a scraper from a restriction. However, the resilient nature of the scraper disclosed herein may require less force during extraction, thereby decreasing downtime associated with the use of conventional scrapers. Additionally, conventional scrapers may be damaged during extraction operations. However, because the materials used in the manufacture of the resilient scrapers disclosed herein may elongate (e.g., up to 300% after yield), the blades may resist fracture during extraction from a casing restriction.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method comprising:

inserting a resilient scraper disposed on a drill string into a segment of downhole tubing, the resilient scraper including:

a resilient body having a hollow core section and a center defined therein, a first blade coupled to the resilient body and extending away from the resilient body in a tangential direction, the first blade having a first end and a second end, wherein the first end of the first blade is in closer proximity to the resilient body than the second end of the first blade, wherein the tangential direction is a direction that is tangent to a circumference of the resilient body;

contacting an internal wall of the segment of downhole tubing with the first blade;

rotating the resilient scraper relative to the drill string within the segment of downhole tubing; and deflecting the first blade against the segment of downhole tubing such that the second end of the first blade is deflected toward the center of the resilient body.

2. The method of claim 1, wherein the core section of the resilient body has an internal diameter that allows the resilient scraper to fit over a portion of the drill string.

3. The method of claim 1, wherein the second end of the first blade is a distal end of the first blade.

4. The method of claim 3, wherein the first end of the first blade extends away from the resilient body in a first direction, and the second end of the first blade extends away from the resilient body in a second direction such that the first blade is curved as the first blade extends from the resilient body.

5. A method comprising:

inserting a resilient scraper disposed on a drill string into a segment of downhole tubing, the resilient scraper including:

a resilient body having a hollow core section and a center defined therein, a first blade coupled to the resilient body and extending away from the resilient body in a first tangential direction, the first blade having a first end and a second end, wherein the first end of the first blade is in closer proximity to the resilient body than the second end of the first blade, and a second blade coupled to the resilient body and extending away from the resilient body in a second tangential direction, the second blade having a first end and a second end, wherein the first end of the second blade is in closer proximity to the resilient body than the second end of the second blade, wherein each of the first and second tangential directions are directions that are tangent to a circumference of the resilient body;

contacting an internal wall of the segment of downhole tubing with the first blade;

allowing rotation of the resilient body relative to the drill string during operation downhole; and deflecting the first blade against the segment of downhole tubing such that the second end of the first blade is deflected toward the first end of the second blade.

6. The method of claim 5, wherein each of the first blade and the second blade comprise at least one selected from a group consisting of polytetrafluoroethylene, polyaryletheretherketone, and carbon fiber.

7. The method of claim 5, wherein deflecting the first blade against the downhole tubing comprises deflecting the first blade such that the second end of the first blade is deflected toward the center of the resilient body.

8. The method of claim 5, further comprising deflecting the second blade against the downhole tubing such that the second end of the second blade is deflected toward the center of the resilient body.

9. A method comprising:

providing a resilient scraper, the resilient scraper including:

a resilient body rotatable relative to a drill string during operation downhole, the resilient body having a hollow core section and a center defined therein, a first blade coupled to the resilient body and extending away from the resilient body in a first tangential direction, the first blade having a first end and a second end, wherein the first end of the first blade is in closer proximity to the resilient body than the second end of the first blade, and a second blade coupled to the resilient body and extending away from the resilient body in a second tangential direction, the second blade having a first end and a second end, wherein the first end of the second blade is in closer proximity to the resilient body than the second end of the second blade, wherein a blade angle is formed between the first blade and the second blade, the blade angle defined as an angle formed between a direction in which the first blade extends away from the resilient body and a direction in which the second blade extends away from the resilient body;

inserting the resilient scraper disposed on the drill string into a segment of downhole tubing;

contacting an internal wall of the segment of downhole tubing with the first blade; and deflecting each of the first blade and the second blade against the segment of downhole tubing such that the second end of the first blade and the second end of the second blade are each deflected toward the center of the resilient body and the blade angle formed between the first blade and the second blade is changed.

10. The method of claim 9, wherein the blade angle formed between the first blade and the second blade is between 20 degrees and 60 degrees.

11. The method of claim 9, wherein the first blade and the second blade are configured to provide a helical flow path for drilling fluid to flow along a length of the resilient scraper.

12. The method of claim 9, wherein the second end of the first blade is a distal end of the first blade, and the second end of the second blade is a distal end of the second blade.

13. The method of claim 9, wherein the direction in which the first blade extends away from the resilient body is a first tangential direction, and the direction in which the second blade extends away from the resilient body is a second tangential direction, wherein each of the first and second tangential directions are directions that are tangent to a circumference of the resilient body.

14. The method of claim 9, further comprising compressing the first blade against the inner wall of the segment of downhole casing along the direction in which the first blade extends from the resilient body.

15. The method of claim 9, further comprising rotating the drill string within the segment of downhole tubing.

16. The method of claim 9, further comprising removing the drill string and the resilient scraper from within the segment of downhole tubing.

* * * * *